United States Patent [19]

Hart

[11] 4,121,655

[45] Oct. 24, 1978

[54] AIR-CONDITIONING SYSTEM

[75] Inventor: Edward F. Hart, Columbus, Ohio

[73] Assignee: Ranco Incorporated, Columbus, Ohio

[21] Appl. No.: 795,324

[22] Filed: May 9, 1977

[51] Int. Cl.[2] ..... F25B 29/00

[52] U.S. Cl. ..... 165/27; 236/1 C; 236/91 F

[58] Field of Search ..... 165/14, 24, 25, 27, 165/60; 236/1 C, 91 F

[56] References Cited

U.S. PATENT DOCUMENTS

| | | | |
|---|---|---|---|
| 2,290,985 | 7/1942 | McElgin | 236/91 F X |
| 2,594,477 | 4/1952 | Miner et al. | 236/91 F X |

*Primary Examiner*—Charles J. Myhre
*Assistant Examiner*—Margaret A. Latulip
*Attorney, Agent, or Firm*—Watts, Hoffmann, Fisher & Heinke Co.

[57] ABSTRACT

A package terminal air conditioning system as disclosed having a room air-circulating blower, an air-cooling device, an air-heating device, and a thermostatic control which governs operation of the air-cooling and air-heating devices in response to the temperature of room air which is circulated by the blower.

The control unit senses the temperature of the air which is returned to the unit from the room and the air which is discharged from the unit to the room and operates an appropriate electrical switch to enable and disable the respective air-heating and cooling devices. The operation of the unit is such that when the temperature of the discharged air differs substantially from the temperature of the return air, the differential in the sensed room air temperature between the cut-in and cut-out of the heating or cooling device is reduced which results in minimizing the possibility of overheating or undercooling the room.

7 Claims, 4 Drawing Figures

AIR-CONDITIONING SYSTEM

BACKGROUND OF THE INVENTION

1. Field of the Invention

The present invention relates to air conditioning systems and more particularly relates to room air heating and cooling units having unit-mounted thermostatic controls.

2. Prior Art

Air conditioning units for heating and cooling room air under control of unit-mounted thermostats are generally known. One widespread application of such units is in hotel or motel rooms where individual units can be operated by the users of the room in which the units are located. These air conditioning units are generally known as "package terminal" units in that they can be installed in the room and used without requiring ducting or a separate thermostat to be installed in the walls of the room. Such units are highly desirable because their use minimizes the cost of buildings in which they are installed and simplifies repair and replacement of the units.

A typical package air terminal includes an air-circulating blower, an air-cooling device, an air-heating device and a thermostatic control for sensing the air temperature and governing operation of the air heating and cooling devices. In such a unit, the blower is operated to induce a flow of room air into a heat-exchange relationship with the heating and cooling devices after which the air, which has either been heated or cooled, is discharged back into the room through a suitable discharge vent. In some cases the cooling device is formed by the evaporator of a compressor-condenser-evaporator mechanical refrigeration system, while the air-heating device is formed by electric resistance heated elements. Other units employ so-called heat pump systems which are formed by compressor-condenser-evaporator refrigeration systems in which the flow of refrigerant in the system is reversable. The air heating and cooling devices are a single refrigerant coil which alternately functions as the evaporator or as the condenser or the refrigeration system depending upon the refrigerant flow direction.

The thermostatic controls for these units have typically been formed by a control unit including a switch arrangment for cutting-in and cutting-out the air-heating and air-cooling devices, and a thermostatic actuator which operates the switch arrangement in response to the sensed temperature of room air which returns to the unit.

Most package air terminal units are constructed so that room air which returns to the unit does so by traveling along the floor of the room. Air which is discharged from the unit is normally discharged upwardly into the space. The unit-mounted thermostats are normally constructed so that they sense the temperature of the air returning to the unit. This presents no serious problems in the cooling mode because the chilled air directed into the room by the unit tends to gravitate to the floor for return to the unit. When the unit operates to heat the room, however, the warm air discharged upwardly into the space does not gravitate to the floor and hot air can be directed into the space for a substantial period of time before warm air is returned to the unit from along the floor. As a result the room air temperature tends to fluctuate widely from desired set point temperatures and substantial overheating and energy consumption are experienced.

One prior art approach to solving the problem has been to place a heating anticipator adjacent the thermostatic sensor. Such anticipators are generally small heaters which supply heat to the thermostatic sensing element whenever the unit is in its heating mode. This tends to increase the cycling rate of the heater and moderate the room air temperature. Unfortunately, as the ratio of "on" to "off" time increases, the temperature sensor is more effected by the anticipator-heater than by the actual room temperature. The result of this is in effect known as temperature "droop" in which the average room temperature drops steadily downwards as the heating load in the room increases.

In certain circumstances a similar problem can be encountered when a room is being cooled. In particular when outdoor temperatures are low, or decrease rapidly, the discharge air temperature from the unit can become quite low compared to the set point temperature. The room thus tends to become subcooled before the unit air cooling equipment is cycled off. Providing a cooling anticipator of some sort is not practical because under normal operating conditions the air cooling equipment would tend to be short cycled.

SUMMARY OF THE INVENTION

The present invention provides a new and improved air-conditioning system having air-heating and cooling equipment, a blower for circulating space air to the heating and cooling equipment from which the air is discharged to the space and a thermostatic control governing the air-heating and cooling equipment in response to the temperatures of the return and discharge air to maintain the space air temperature within relatively narrow temperature ranges, the extent of the temperature ranges narrowing as the differential between the discharge air temperature and the room set point temperature increases so that the possibility of undercooling, overheating and temperature "droop" is substantially reduced.

In accordance with one preferred embodiment of the invention a package air terminal is provided which includes a thermostatic control having a heating and cooling control switch means operated at least in part in response to sensed temperatures of the air flowing through both the return and discharge passages. The control switch is operated as a function of the total heat sensed and the authority of the return air temperature sensor in operating the control switch is substantially greater than that of the discharge sensor. In one preferred embodiment, for example, the effect on the control switch of a sensed return air temperature change of 1° F. is the same as a sensed discharge air temperature change 20° F.; i.e. the authority ratio between the sensors is 20:1.

The preferred control unit employs a thermostatically controlled switch actuator formed by a liquid filled bellows communicating via capillary tubing with liquid filled bulbs disposed in heat exchange relationship with air flowing through the discharge and return air passages. The bellows operates a fixed differential control switch through a suitable linkage arrangement. The discharge air sensing bulb has a volume substantially less than that of the return air sensing bulb so that the volumetric change of the fill liquid resulting from a given temperature change of the discharge air is substantially less, and in proportion to the bulb volume ratios, than the volumetric change created by the same temperature change of the return air.

The differential of the control switch is fixed so that the switch functions to limit the maximum extent of sensed room temperature excursion from a set point temperature. The effect of the discharge sensing bulb is to further reduce the room temperature excursions from set point when the difference between the discharge air temperature and the set point temperature is great.

When the package air terminal employs electric resistance heated elements for heating the room air (a so-called "strip" heater) the discharge air temperatures during heating are much higher than the set point temperature. Accordingly the room air temperature differential is maintained within a narrow differential range without temperature "droop" being encountered and the heater is cycled frequently, which is desirable.

During cooling the discharge temperature is relatively closer to the set point level so that the room air temperature differential is wider and the cooling equipment is cycled on and off less frequently. When the space is being cooled and the outside temperatures are relatively low the discharge air temperature varies further from the set point temperature so that the room air temperature range is narrowed and undercooling is avoided.

Other features and advantages of the invention will become apparent from the following detailed description made with reference to the accompanying drawings which form a part of the specification.

DETAILED DESCRIPTION OF A PREFERRED EMBODIMENT

Figure 1:
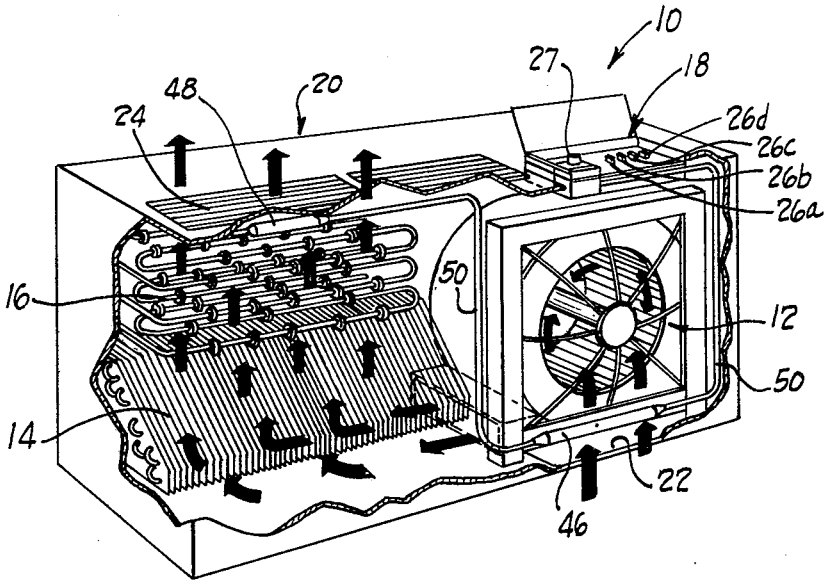
FIG. 1 is a perspective view, shown partially in cross section, of a package air terminal embodying the present invention.

A package air terminal unit 10 embodying the present invention is illustrated in FIG. 1. The package air terminal 10 includes an air blower 12, an air cooling heat exchanger 14, an air heating heat exchanger 16 and a control unit 18 all of which are supported by a housing assembly generally indicated by the reference character 20.

The housing 20 defines a return air passage 22 formed in its lower wall and a discharge air passage 24 formed in its upper wall. The blower unit 12 is preferably an electric motor driven fan which may be of any suitable type and functions to induce a flow of room air into the return air passage 22 through the blower and across the air heating and air cooling heat exchangers from which the air is discharged upwardly into the room through the discharge passage 24. The blower unit 12 operates continuously whenever the unit 10 is conditioned for heating or cooling the room and may also be operated alone to provide for room air circulation if desired.

The unit 10 is preferably built into an outside wall of the room being conditioned at an elevation where the return air passage 22 is located to receive room air which flows to the unit along the floor. The illustrated unit 10 employs an air cooling heat exchanger 14 which is formed by the evaporator coil of a compressor-condensor-evaporator type mechanical refrigeration system which may be of any well known or suitable type. The condensor and compressor of the system are therefore not illustrated or described further. The air cooling heat exchanger 14 is rendered effective to cool air which is directed across it by the blower 12 when the control unit 18 is conditioned to enable energization of an electric compressor driving motor 25. The control unit 18 operates to cycle the compressor motor to govern the temperature of the air in the room when the room is being cooled.

The illustrated air heating heat exchanger 16 is preferably an electrical resistance heated "strip" heater. The strip heater is rendered effective to heat air passing across it when the control 18 is conditioned to enable energization of the heater. When so conditioned the control 18 thermostatically governs operation of the heater by cycling the heater.

The control unit 18 is supported at a control panel portion of the housing 20 and includes a number of manually operable function control "buttons" 26 which enable the unit 10 to be operated to cool the room, to heat the room, as well as to permit the blower 12 to operate to circulate air in the room without heating or cooling taking place. In addition to the function control "buttons" the control panel of the preferred unit 10 is provided with a rotatable knob 27 which allows the room air temperature set point level to be adjusted within limits.

Figure 2:
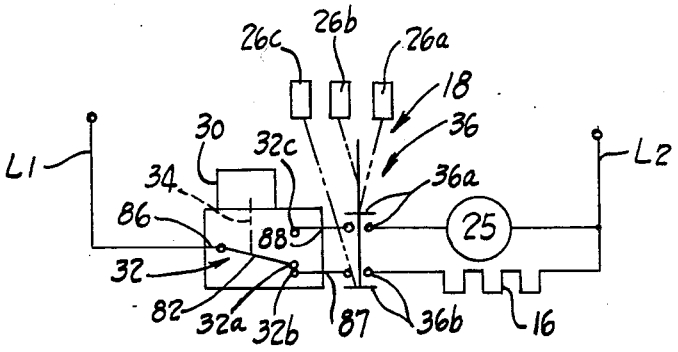
FIG. 2 is a schematic wiring diagram of a portion of the unit illustrated in FIG. 1.

A schematic wiring diagram portion of the unit 10 is illustrated in FIG. 2. As illustrated the control unit 18 is connected in series with the strip heater 16 and the refrigerant compressor motor 25 between the lines L1 and L2 of a suitable alternating current electric power supply.

The control 18 comprises a thermostatic control including a thermostatic actuator 30 which is operated to govern operation of a control switch 32 via a mechanical linkage 34, and a function control switch 36. The switch 32, together with the function control switch 36 form a switching arrangement which is effective to govern heating or cooling of the room air by the unit 10. The function control switch 36 is operable by the buttons **26*a*, 26*b* and 26*c* on the control panel and includes "cooling" contacts 36*a* and "heating" contacts 36*b* which are respectively closed to condition the unit for "cooling" and "heating". When the "cooling" button 26*a* on the control panel is actuated, the function control switch contacts 36*a* are closed to enable the completion of an energizing circuit for the compressor motor 25 through the control switch 32. When the "heating" button 26*c* on the control panel is actuated the contacts 36*b* are closed to enable completion of the strip heater energizing circuit by the switch 32. When the contacts 36*b* are closed the contacts 36*a* are open, and vice versa, so that simultaneous heating and cooling is prevented. When the "off" button 26*b* is actuated the contacts 36*a*, 36*b* are opened to prevent completion of energizing circuits for the compressor motor 28 or the strip heater 16** regardless of the room air temperature.

The fan control **26*d* is provided for operating the blower 12 independently of the control unit 18. The circuitry for controlling the blower may be of any suitable construction which enables the blower to operate when the "cooling", "heating" or "fan" buttons are actuated and is not illustrated. The construction of the manually operated buttons 26** and their associated linkages has not been illustrated in detail as they may be of any suitable or conventional construction.

Figure 3:
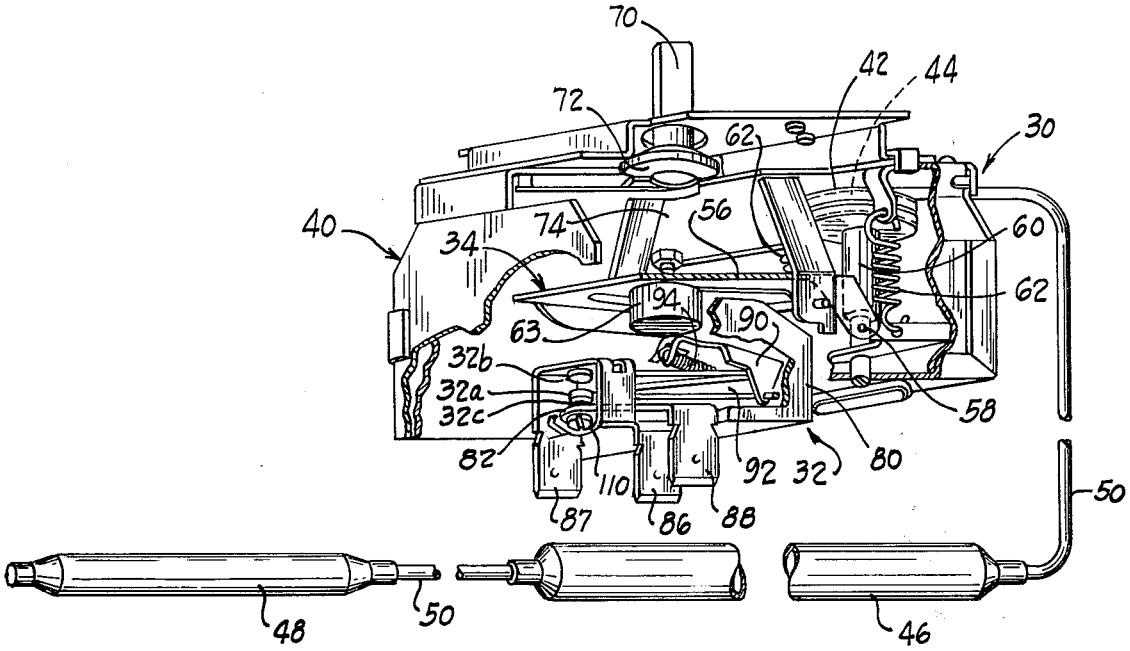
FIG. 3 is a perspective view, shown in partial cross section, of a thermostatic control utilized in the package air terminal of FIG. 1.

A preferred thermostatic control is illustrated by FIG. 3 of the drawings and includes a casing assembly 40 which supports the actuator 30, the linkage 34 and the switch 32. The actuator 30 is preferably formed by a bellows 42 which defines an internal expansible chamber 44 which is filled with a thermostatically expansible and contractible liquid ("fill" liquid). The chamber 44 communicates with a return air temperature sensor in the form of a bulb 46 and a discharge air temperature sensor, formed by a bulb 48, which are communicated with each other and to the bellows chamber by capillary tubing 50. The bulbs 46, 48 and the tubing 50 are completely filled with the fill liquid so that whenever the temperature of either one or both bulbs increases, the volume of the fill liquid occupying the bulb likewise increases causing the bellows to expand. Cooling of the fill liquid in either one or both of the bulbs results in a reduction of the fill liquid volume and a tendancy for contraction of the bellows chamber volume and retraction of the bellows.

The preferred linkage 34 is formed by a lever 56 which reacts between the actuator 30 and the switch 32. The lever 56 is supported for pivotal movement by a pivot pin 58 which is disposed between the bellows and the switch 32. The bellows 42 carries an actuating pin or rod 60 which extends from the bellows into engagement with the lever 56 so that when the bellows extends the pin 60 shifts the lever 56 clockwise about the axis of the pivot pin 58, as viewed in FIG. 3. Return springs 62 are connected between the lever 56 and the casing assembly 40 to resiliently maintain the lever 56 engaged with the pin 60 and assure that when the "fill" liquid volume decreases the bellows retracts and the lever 56 pivots counterclockwise about the axis of pin 58, as viewed in FIG. 3. The opposite end of the lever 56 carries a switch actuating electrically insulating button 63 which engages the switch 32 and effects operation of the switch in relation to movement of the lever 56. As pointed out, the occupant of the room can adjust the room air temperature level within limits. In the preferred and illustrated embodiment of the invention the casing assembly 40 supports a mechanism for adjusting the location of the axis of the pivot pin 58 relative to the line of action of the actuating pin 60 to permit shifting the temperature set point level. In the preferred and illustrated embodiment the mechanism includes a knob supporting shaft 70 which extends from the casing assembly 40 for reception of the knob 27. A cam 72 is fixed to the end of the shaft 70 within the casing assembly. The cam 72 bears on a lever 74 which reacts between the casing assembly and the lever 56 so that when the cam 72 is rotated the axis of the pivot pin 58 is shifted.

The illustrated switch 32 is a single pole double throw switch having a moving contact **32*a*, a fixed contact 32*b* and a fixed contact 32*c*. The switch 32 is preferably a snap acting switch having a fixed differential operation and is constructed according to the disclosure of U.S. Pat. No. 2,651,690 the disclosure of which is expressly incorporated herein by this reference to it. The switch 32 includes a plastic-like insulating housing 80 supporting a flexible blade 82 carrying the moving contact 32*a*, the fixed switch contacts 32*b*, 32*c*, and a toggle mechanism for snap moving contact 32*a*, between the contacts 32*b* and 32*c*. The switch housing 80 also supports terminal posts 86, 87, 88 by which the respective switch contacts are connected into the energizing circuits for the compressor motor and the strip heater. The switch housing 80 is rigidly supported by the casing assembly 40 so that the switch position is fixed relative to the lever 56 and the actuator 30**.

The toggle mechanism is formed by a switch operating member 90, a toggle member 92 which is pivoted to the contact blade 82 and a switch biasing spring element 94 which reacts between the toggle member 92 and the switch operating member 90 to snap move the contact **32*a* in response to movement of the switch operating member 90. The switch operating member 90 is supported by the switch housing for pivotal movement and is urged into engagement with the button 63 by the spring 94. As the lever pivots counterclockwise (viewed in FIG. 3) in response to sensed temperature increases the operating member 90 pivots to follow the lever and the switch contacts 32*a*, 32*c* are closed. This closure of the switch contacts constitutes a heating cut-out or cooling cut-in event, depending on the condition of the function control switch 36. When sensed temperature levels are reduced the operating member 90 is moved toward the switch housing resulting in closure of the contacts 32*a*, 32*b*. The closure of these contacts constitutes a cooling cut-out or heating cut-in event, depending again on the condition of the function control switch 36**.

The switch 32 preferably provides a constant differential operation of 4° F. That is to say, if the air temperature sensed by both the bulbs 46, 48 is the same and increases 2° F. above a nominal set point temperature, the switch contacts **32*a*, 32*c* are closed and remain closed until the air temperature sensed by the bulbs 46, 48 is reduced 2° F. below the set point temperature (assuming both bulbs sensed the same temperature). At that juncture the contacts 32*a*, 32*b* are closed and remain closed until the sensed temperature reaches 2° F. above the set point temperature level again. The extent of this switch differential can be changed by adjusting a screw 110 to which the contact 32*a*** is attached but for the purposes of description it is assumed a 4° F. differential is established.

Figure 4:
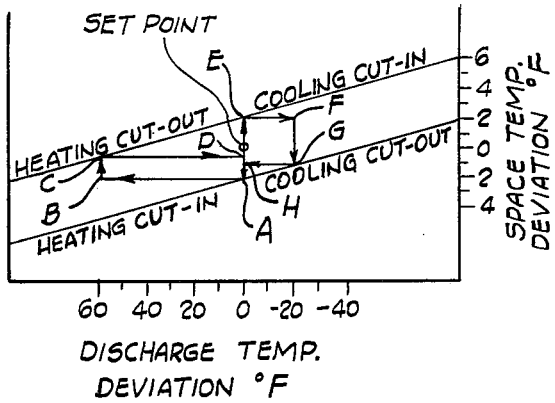
FIG. 4 is a diagrammatic representation of the operation of the unit of FIG. 1.

During operation of the unit 10 the differential temperatures at which the switch 32 is operated to control heating or cooling the room air is narrower than the switch differential because the bulbs 46, 48 are disposed in the flow of air entering the return passage 22 and flowing through the discharge passage 24, respectively. FIG. 4 graphically illustrates operation of the unit 10 during heating and cooling in terms of deviation of the return (or space) air temperature from a nominal set point versus discharge air temperature deviation from the set point. Assuming the room is to be heated the "heating" button **26*c* is actuated to close the function control switch contacts 36*b* to enable heating. When the room air temperature decreases to about 2° below the set point temperature, the switch contacts 32*a*, 32*b* are closed by operation of the actuator 30 and linkage 34. This condition is illustrated at the location indicated by the reference character A in FIG. 4. The closure of the contacts 32*a*, 32*b* constitutes the heating cut-in event and the heater 16 is consequently operated to heat the air passing through the unit 10**.

The temperature of the air discharged from the passage 24 increases substantially relative to the set point temperature. In the illustrated unit 10 the discharge air temperature is cabable of increasing at least to 60° F. above the set point temperature before stabilizing. This effect is illustrated by the line segment A-B of FIG. 4. Assuming a 20:1 volume ratio between the bulb 48 and the bulb 46, it should be apparent that the heated discharge air will heat the liquid in the bulb 48 to a level 60° F. above the set point temperature. The resultant expansion of the liquid in the bulb 48 causes the bellows 42 to expand the same amount as if a 3° F. temperature rise had been sensed by the return air temperature sensing bulb 46. Accordingly, the actual return air temperature rise which is sensed by the bulb 46 in order to de-energize the heater 16 is 1° F. Accordingly when the sensed return air temperature rises 1° F. above the heating cut-in level the contacts 32*a*, 32*b* are opened and the heating cut-out event occurs, as indicated at the point C of FIG. 4.

With the heater 16 de-energized, the temperature of the discharge air sensing bulb 48 is reduced toward the return air temperature relatively rapidly, as indicated by the line segment C-D of FIG. 4. A subsequent reduction of the sensed return air temperature to the level 2° F. below the set point temperature again causing the heating element 60 to be cut-in (as indicated by the point A of FIG. 4).

It should be apparent from FIG. 4 that if the discharge air temperature is heated to more than 60° F. above set point temperature the heater 16 should be cycled more frequently in a narrower sensed return air temperature band while if the sensed discharge air temperature is less than 60° F. above the set point, a wider sensed return air band will be permitted. This function of the unit 10 tends to minimize discomfort of occupants of the room by minimizing the temperature swings during heating cycles, increases the cycle rate during heating and, because no anticipator heater is used, minimizes the effect of temperature "droop" in the room.

In circumstances where the room air is to be cooled, the button 26*a* is actuated to close the contacts 36*a* so that the switches 32, 36 are conditioned to control cooling. If the sensed return air temperature increases 2° above the set point temperature level the cooling cut-in event occurs in that the bellows 42 actuates the lever 56 to close the switch contacts 32*a*, 32*c* and initiate operation of the compressor motor 25. The air passing the air cooling heat exchanger 14 is chilled and directed into the room through the discharge passage 24 across the bulb 48. The temperature of the discharge air during cooling normally stabilizes at about 20° below the set point temperature and accordingly the bulb 48 is cooled to that level. Cooling the discharge air sensor bulb 20° F. below the set point temperature has the same effect as a 1° F. reduction in the sensed return air temperature and accordingly the sensed return air temperature needs to be reduced only by 3° F. in order for the cooling cut-out event to take place at which the control switch 32 discontinues operation of the compressor motor 25. Cooling of the discharge air sensing bulb 48 is indicated by the line segment E-F of FIG. 4 and the reduction of the return air temperature by 3° F. is indicated by the line segment F-G of FIG. 4.

When the actual return air temperature is reduced 3° F. the cooling cut-out condition of the switch 32 is reached and the contacts 32*a*, 32*c* open to de-energize the compressor motor 25. The temperature of the discharge sensing bulb 48 rises until it is the same as the return air temperature (indicated by the line segment G-H of FIG. 4). The refrigerant compressor motor 25 is not cycled on again until the sensed air temperature rises 2° above the set point to point E of FIG. 4.

It should be appreciated from the foregoing description that should the air cooling heat exchanger 14 be effective to chill the air to a temperature less than 20° below the set point temperature, the total differential permitted during cooling will be reduced. This has the effect of reducing the possibility of undercooling the room which is particularly likely to occur when the outside temperatures are low or are decreasing fairly rapidly.

While a single embodiment of the invention has been illustrated and described in considerable detail, the present invention is not to be considered limited to the precise construction shown. For example, the thermostatic control 18 illustrated by FIG. 3 could be provided with two identical snap switches instead of a single switch. The switches would each be operated by the lever 56 at different sensed temperature levels with one switch controlling the refrigerant compressor motor and the other switch controlling the heater element separately. This constitution permits operation of the heating and cooling equipment in different temperature ranges while retaining the advantages of having the discharge temperature sensing bulb control the effective differential within each range. The unit 10 could also be constructed utilizing a heat pump system wherein a single refrigerant coil would constitute both the air cooling heat exchanger and the air heating heat exchanger.

Other modifications, adaptations and uses may occur to those skilled in the art to which the invention relates and the intention is to cover hereby all such adaptations, modifications and uses of the invention which come within the spirit or scope of the appended claims.

What is claimed is:

1. A heating and cooling unit for an air conditioned space comprising:

(a) air heating and cooling means;

(b) an air blower for directing air from the space into heat exchange relationship with the heating and cooling means;

(c) a return air passage through which air from the space flows to the heating and cooling means;

(d) a discharge passage through which the air is discharged to the space; and, (e) a control for governing operation of the heating and cooling means at least in part as a function of sensed air temperatures comprising:

(i) a thermostatic actuator having an expansible and contractible bellows defining a chamber communicating with first and second fixed volume bulbs via capillary tubing, said bulb, chamber and capillary tubing filled with a thermally expansible and contractible liquid, one bulb disposed in heat transfer relationship with air which flows through said air return passage and a second bulb disposed in heat exchange relationship with air which flows through said discharge passage, said first bulb defining a substantially larger volume than said second bulb, and said bellows chamber volume determined by the heat content of said liquid;

(ii) a linkage member moved in response to expansion and contraction of said bellows with the linkage member position determined by the heat content of the fill liquid as reflected by expansion or contraction of said bellows volume;

(iii) a cooling control switch means having a first condition in which cooling of the air is effected and a second condition in which cooling of the air is terminated, said cooling control switch means operated to said first condition in response to a linkage member position indicative of a first heat content of said liquid and operated to said second condition in response to a linkage member position indicative of a second heat content of said liquid which is less than the first heat content; and (iv) a heating control switch means having a first condition in which air heating is initiated and a second condition in which air heating is terminated, said heating control switch means operated to said first condition in response to said linkage member being positioned at a location indicative of a third heat content of said liquid and operated to said second condition in response to a linkage member position indicative of a fourth heat content of said liquid greater than said third heat content and less than said first heat content.

2. The unit claimed in claim 1 wherein said heating and cooling control switch means comprise a common single throw double pole switch operated by said linkage member and a function control switch operable to engage said common switch to control said heating and cooling means.

3. The unit claimed in claim 1 wherein the volume of said second bulb is substantially smaller than the volume of said one bulb so that the effect on said bellows of a predetermined air temperature change sensed by said second bulb is less than the effect of the same sensed temperature change by said one bulb.

4. The unit claimed in claim 3 wherein the volume of said one bulb is approximately twenty times the volume of said second bulb.

5. The unit claimed in claim 1 wherein said cooling control switch means comprises a snap acting switch having a moving contact operable between stationary contacts at a predetermined operating differential which is greater than the return air temperature differentials between initiation and termination of cooling and between initiation and termination of heating.

6. The unit claimed in claim 5 wherein said linkage member comprises a lever supported for movement about a pivot pin.

7. The unit claimed in claim 6 further comprising a mechanism for shifting the location of said pivot pin.

* * * * *